US005304702A

United States Patent [19]

Weiss et al.

[11] Patent Number: 5,304,702

[45] Date of Patent: Apr. 19, 1994

[54] PROCESS OF DECOMPOSING CHLOROFLUOROHYDROCARBONS

[75] Inventors: Wilfried Weiss, Oberursel; Klaus Kobele, Dietzenbach, both of Fed. Rep. of Germany

[73] Assignee: Metallgesellschaft AG, Frankfurt am Main, Fed. Rep. of Germany

[21] Appl. No.: 850,741

[22] Filed: Mar. 13, 1992

[30] Foreign Application Priority Data

Mar. 23, 1991 [DE] Fed. Rep. of Germany ..... 4109639

[51] Int. Cl.[5] ..... A62D 3/00

[52] U.S. Cl. ..... 588/206; 208/262.1; 208/562.5; 549/458; 570/134; 570/204; 588/207; 423/245.2

[58] Field of Search ..... 588/206, 207; 570/204, 570/134; 549/458; 208/262.1

[56] References Cited

U.S. PATENT DOCUMENTS

| | | | |
|---|---|---|---|
| 4,255,252 | 3/1981 | Knorre et al. | 208/182 |
| 4,755,628 | 7/1988 | Adams | 585/469 |
| 4,910,353 | 3/1990 | Siegman | 570/204 |

FOREIGN PATENT DOCUMENTS 2-19330 1/1990 Japan .

OTHER PUBLICATIONS

Oku et al. I, Ind. Eng. Chem. Res., vol. 28, pp. 1055-1059 (1989).

Oku et al. II, J. Chem. Soc. Japan, pp. 1577-1582 (1978).

Villieras et al., Synthesis (7), pp. 502-504 (1979).

"Metallorganische Verbindungen", 1970, III.Losungs- und Suspensionsmittel, pp., 18-19; Lithium-Organisch Verbindungen, pp. 93-96.

"Preparative Polar Organometallic Chemistry", vol. 1, 2 Solvents and some Reagents: . . . , pp. 6-8, References (1987).

"Organolithium Methods", Basil J. Wakefield, General Considerations, pp. 4-8, References p. 19 (1986).

Journal of Organometallic Chemistry, 61, (1973) C1-C4, Preliminary Communication, pp. C1-C4.

Methoden Der Organischen Chemie, (1970), Houben-Weyl, pp. 377-380.

Comprehensive Organometallic Chemistry, vol. 1, "Alkali Metals", pp. 77-80, and 109-115 (1984).

Horner and H. Gusten, Liebigs Annalen der Chemic, vol. 652 (1962), pp. 99-107.

*Primary Examiner*—Bernard Dentz

*Attorney, Agent, or Firm*—Sprung Horn Kramer & Woods

[57] ABSTRACT

Polyhalogenated organic compounds, such as polychlorinated dibenzodioxines, dibenzofurans, biphenyls, biphenyl ethers, phenols, benzenes and cyclohexanes as well as chlorofluorohydrocarbons are destroyed by reaction with a surplus of strongly basic hydrocarbon-soluble, strongly basic lithium compounds in an inert solvent at reaction temperatures from 0° to 200° C.

9 Claims, No Drawings

PROCESS OF DECOMPOSING CHLOROFLUOROHYDROCARBONS

DESCRIPTION

This invention relates to a process of decomposing polyhalogenated organic compounds.

Polyhalogenated organic compounds, particularly chlorinated aromatic compounds, are used as agricultural chemicals, as additives for plastics, as preservatives and as adjuvants in numerous technical processes. Typical examples are polychlorinated biphenyls (PCB), hexachlorobenzene, pentachlorophenol (PCP), hexachlorohexane (HCH) and polychlorinated or polybrominated biphenyl ethers. When such substances are produced on a large scale and used for specific purposes, other compounds must not be delivered to the environment. Such other compounds include, e.g., the chlorinated and brominated dibenzodioxines (PCDD) and dibenzofurans (PCDF). Such substances are formed during a combustion (e.g., the incineration of garbage), in metallurgical processes, such as copper smelting, and the decomposition of the additives of leaded gasoline, such as dichloromethane or dibromomethane, and most of them are emitted with the exhaust gases and are toxic in the environment.

To eliminate the ecotoxic halogenated compounds the material which is contaminated with said compounds is combusted at 1500° C. in high-temperature combustion plants, but high costs are incurred by the combustion.

Processes of dehalogenating chlorinated aromatic compounds, preferably of PCB'S and PCP'S, with the aid of sodium metal have been disclosed in German Patent Specification 28 13 200 and U.S. Pat. No. 4,755,628. Disadvantages of said processes are their restricted field of application, their high costs and the difficulties involved in carrying out said processes.

U.S. Pat. No. 4,910,353 discloses a process of dehalogenating polychlorinated biphenyls and other halogenated compounds. In that process the toxic polyhalogenated aromatic compounds are reacted with a strong base and various sulfur-containing compounds. The dehalogenated residues either form polymers, which are insoluble in aliphatic hydrocarbons and can simply be separated by filtration, or they are distilled from the solvent. The residues can be disposed of safely and in a simple manner in that they are dumped or incinerated. The strong bases which are used include sodium hydride, lithium hydride, sodium tert. butanolate, sodium isopropanolate, sodium hydroxide, potassium hydroxide, potassium amide, sodium amide, butyllithium, methyllithium, sodium, potassium, lithium, and mixtures thereof. Sulfur compounds which must also be used may include dimethyl sulfoxide, tetramethylene sulfoxide, dimethylsulfone, sulfolans, or mixtures thereof. The process is particularly used to detoxicate transformer oils which are contaminated with PCB's.

It is an object of the invention to provide a process by which polyhalogenated organic compounds are decomposed to a high degree in a simple manner.

The object underlying the invention is accomplished in that polyhalogenated organic compounds, such as polychlorinated dibenzodioxines, dibenzofurans, biphenyls, biphenyl ethers, phenols, benzenes and cyclohexanes as well as chlorofluorohydrocarbons, are destroyed by a reaction with a surplus of strongly basic hydrocarbon-soluble, strongly basic lithium compounds in an inert solvent at reaction temperatures from 0° to 200° C.

It is known that strongly basic lithiumorganyls will react with polyhalogenated organic compounds at low temperatures and are used to form metalated compounds, carbenes or arinens as synthesis intermediate products (see B. J. Wakefield, Organolithium methods, Academic Press, 1988). However it is surprising that polyhalogenated organic compounds can be completely decomposed and the chlorofluorohydrocarbons can almost completely be decomposed at temperatures from 0° to 200° C. by means of strongly basic lithium compounds, particularly lithium-organyls.

In the process, lithiumorganyls and/or lithium amides are desirably used as hydrocarbon-soluble, strongly basic lithium compounds.

In carrying out the process it has proved desirable to use lithiumalkyls, lithiumcycloalkyls or lithiumaryls having 1 to 20 carbon atoms as lithium-organyls. To facilitate the handling, the hydrocarbon-soluble, strongly basic lithium compounds are added to the polyhalogenated organic compounds desirably in a solution in an inert solvent.

It has also been found that it is desirable to decompose polyhalogenated organic compounds by means of n-butyllithium, tertiary butyllithium, secondary butyllithium or phenyllithium used as a 5 to 95% solution in an inert solvent, such as toluene, xylene, hexane, at temperatures between 0° and 150° C.

It has also been found that it is desirable to use lithium diisopropylamide or lithium diethylamide for the decomposition of polyhalogenated organic compounds.

A special advantage is afforded by a variant of the process in which the reaction of the lithium compounds with the polyhalogenated organic solvents is succeeded by a purifying distillation of the solvent, which is then re-used, whereas the lithium halides which have been formed are recovered.

In another desirable variant of the process, moist pulverulent substances, particularly residues, which are contaminated with polyhalogenated organic compounds, are suspended in an inert solvent and dried by an azeotropic distillation of the water. The polyhalogenated organic compounds which are present in the dried suspension are decomposed by a succeeding single-pot reaction with hydrocarbon-soluble, strongly basic lithium compounds.

The process in accordance with the invention can desirably be used to destroy polyhalogenated organic compounds which are contained in solid residues from metallurgical furnaces or from incinerating plants.

The process which has been described can also desirably be used to destroy polyhalogenated organic compounds or chlorofluorohydrocarbons which are dissolved or suspended in hydrocarbons.

The subject matter of the invention will be explained more in detail hereinafter with reference to examples.

EXAMPLE 1

480 g toluene were added to 150 g filter dust from a garbage incinerating plant (sample 1) and the resulting mixture was stirred at room temperature overnight. The suspension was then filtered and washed with four 100-ml portions toluene. 670 g filtrate were obtained. A 15% solution of n-butyllithium was added to an aliquot and the consumption of active base by the filtrate was found to amount to 30 millimoles n-butyl-lithium. The filter sludge was washed with two 100-ml portions hexane and was dried under an oil pump vacuum at room temperature. 148 g filter dust were left. The hexane filtrate (185 g) was combined with the toluene filtrate (total amount 810 g) and 20 ml of a solution of 15% n-butyllithium in hexane was added to the mixed filtrates. This addition is equivalent to 33 millimoles n-butyl-lithium. A slight evolution of gas and an only mild generation of heat were observed. To complete the reaction, the mixture was heated to the boil (98° C.) and was refluxed for 30 minutes. 94 millimoles water were added to the dark solution which had been cooled and which was thus brightened to a yellowing color. When the small amount of precipitate consisting of LiCl and LiOH had been removed, the toluene-hexane mixture was analyzed for dibenzodioxines and dibenzofurans (Sample 2). No dibenzodioxines and dibenzofurans could then be detected in the mixed solvents.

Sample 1 contained the following polychlorinated furans and dioxines:

| | Content µm/kg | Detection limit µm/kg |
|---|---|---|
| total tetrachlorodibenzofurans ($Cl_4$-PCDF) | 116 | |
| 2,3,7,8-tetrachlorodibenzofuran | 7.1 | |
| total pentachlorodibenzofurans ($Cl_5$-PCDF) | 61.1 | |
| 1,2,3,7,8-pentachlorodibenzofuran + 1,2,3,4,8-pentachlorodibenzofuran | n.e. | |
| 2,3,4,7,8-pentachlorodibenzofuran | 16.0 | |
| total hexachlorodibenzofurans ($Cl_6$-PCDF) | 91.1 | |
| 1,2,3,4,7,8-hexachlorodibenzofuran + 1,2,3,4,7,9-hexachlorodibenzofuran | 9.1 | |
| 1,2,3,6,7,8-hexachlorodibenzofuran | 12.6 | |
| 1,2,3,7,8,9-hexachlorodibenzofuran | n.d. | 0.05 |
| 2,3,4,6,7,8-hexachlorodibenzofuran | 11.8 | |
| total heptachlorodibenzofurans ($Cl_7$-PCDF) | 47.3 | |
| 1,2,3,4,6,7,8-heptachlorodibenzofuran | 28.5 | |
| 1,2,3,4,7,8,9-heptachlorodibenzofuran | 5.0 | |
| octachlorodibenzofuran ($Cl_8$-PCDF) | 21.4 | |
| total tetrachlorodibenzodioxines ($Cl_4$-PCDD) | 16.6 | |
| 2,3,7,8-tetrachlorodibenzodioxine | 0.06 | |
| total pentachlorodibenzodioxines ($Cl_5$-PCDD) | 49.1 | |
| 1,2,3,7,8-pentachlorodibenzodioxine | 7.5 | |
| total hexachlorodibenzodioxines ($Cl_6$-PCDD) | 235 | |
| 1,2,3,4,7,8-hexachlorodibenzodioxine | 4.3 | |
| 1,2,3,6,7,8-hexachlorodibenzodioxine | 7.2 | |
| 1,2,3,7,8,9-hexachlorodibenzodioxine | 5.7 | |
| total heptachlorodibenzodioxines ($Cl_7$-PCDD) | 75.7 | |
| 1,2,3,4,6,7,8-heptachlorodibenzodioxine | 38.2 | |
| octachlorodibenzodioxine ($Cl_8$-PCDD) | 30.7 | |

Sample 2 was analyzed with the following results:

| | Content ng/kg | Detection limit ng/kg |
|---|---|---|
| total tetrachlorodibenzofurans ($Cl_4$-PCDF) | n.d. | 5* |
| 2,3,7,8-tetrachlorodibenzofuran | n.d. | 5 |
| total pentachlorodibenzofurans ($Cl_5$-PCDF) | n.d. | 5* |
| 1,2,3,7,8-pentachlorodibenzofuran + 1,2,3,4,8-pentachlorodibenzofuran | n.d. | 5 |
| 2,3,4,7,8-pentachlorodibenzofuran | n.d. | 5 |
| total hexachlorodibenzofurans ($Cl_6$-PCDF) | n.d. | 5* |
| 1,2,3,4,7,8-hexachlorodibenzofuran + 1,2,3,4,7,9-hexachlorodibenzofuran | n.d. | 5 |
| 1,2,3,6,7,8-hexachlorodibenzofuran | n.d. | 5 |
| 1,2,3,7,8,9-hexachlorodibenzofuran | n.d. | 5 |
| 2,3,4,6,7,8-hexachlorodibenzofuran | n.d. | 5 |
| total heptachlorodibenzofurans ($Cl_7$-PCDF) | n.d. | 10* |
| 1,2,3,4,6,7,8-heptachlorodibenzofuran | n.d. | 10 |
| 1,2,3,4,7,8,9-heptachlorodibenzofuran | n.d. | 10 |
| octachlorodibenzofuran ($Cl_8$-PCDF) | n.d. | 10 |

-continued

| | Content ng/kg | Detection limit ng/kg |
|---|---|---|
| total tetrachlorodibenzodioxines ($Cl_4$-PCDD) | n.d. | 5* |
| 2,3,7,8-tetrachlorodibenzodioxine | n.d. | 5 |
| total pentachlorodibenzodioxines ($Cl_5$-PCDD) | n.d. | 5* |
| 1,2,3,7,8-pentachlorodibenzodioxine | n.d. | 5 |
| total hexachlorodibenzodioxines ($Cl_6$-PCDD) | n.d. | 5* |
| 1,2,3,4,7,8-hexachlorodibenzodioxine | n.d. | 5 |
| 1,2,3,6,7,8-hexachlorodibenzodioxine | n.d. | 5 |
| 1,2,3,7,8,9-hexachlorodibenzodioxine | n.d. | 5 |
| total heptachlorodibenzodioxines ($Cl_7$-PCDD) | n.d. | 10* |
| 1,2,3,4,6,7,8-heptachlorodibenzodioxine | n.d. | 10 |
| octachlorodibenzodioxine ($Cl_8$-PCDD) | n.d. | 10 |

n.d. = not detectable
n.e. = not evaluatable owing to signal superpositions due to the matrix
* = related to a single component of the homologous group

EXAMPLE 2

A filtrate which was analogous to that of Example 1 was treated with a solution of 15% butyllithium but was not heated to the boiling point of about 100° C. (Sample 3). Dibenzodioxines could not be detected in the mixed solvents of Sample 3 but it was possible to detect dibenzodifurans owing to their higher stability.

Sample 3 was analyzed with the following results:

| | Content ng/kg | Detection limit ng/kg |
|---|---|---|
| total tetrachlorodibenzofurans ($Cl_4$-PCDF) | 1140 | |
| 2,3,7,8-tetrachlorodibenzofuran | 240 | |
| total pentachlorodibenzofurans ($Cl_5$-PCDF) | 390 | |
| 1,2,3,7,8-pentachlorodibenzofuran + 1,2,3,4,8-pentachlorodibenzofuran | 350 | |
| 2,3,4,7,8-pentachlorodibenzofuran | 27 | |
| total hexachlorodibenzofurans ($Cl_6$-PCDF) | 22 | |
| 1,2,3,4,7,8-hexachlorodibenzofuran + 1,2,3,4,7,9-hexachlorodibenzofuran | n.d. | 5 |
| 1,2,3,6,7,8-hexachlorodibenzofuran | n.d. | 5 |
| 1,2,3,7,8,9-hexachlorodibenzofuran | 22 | |
| 2,3,4,6,7,8-hexachlorodibenzofuran | n.d. | 5 |
| total heptachlorodibenzofuran ($Cl_7$-PCDF) | n.d. | 10* |
| 1,2,3,4,6,7,8-heptachlorodibenzofuran | n.d. | 10 |
| 1,2,3,4,7,8,9-heptachlorodibenzofuran | n.d. | 10 |
| octachlorodibenzofuran ($Cl_8$-PCDF) | n.d. | 10 |
| total tetrachlorodibenzodioxines ($Cl_4$-PCDD) | n.d. | 5* |
| 2,3,7,8-tetrachlorodibenzodioxine | n.d. | 5 |
| total pentachlorodibenzodioxines ($Cl_5$-PCDD) | n.d. | 5* |
| 1,2,3,7,8-pentachlorodibenzodioxine | n.d. | 5 |
| total hexachlorodibenzodioxines ($Cl_6$-PCDD) | n.d. | 5* |
| 1,2,3,4,7,8-hexachlorodibenzodioxine | n.d. | 5 |
| 1,2,3,6,7,8-hexachlorodibenzodioxine | n.d. | 5 |
| 1,2,3,7,8,9-hexachlorodibenzodioxine | n.d. | 5 |
| total heptachlorodibenzodioxines ($Cl_7$-PCDD) | n.d. | 10* |
| 1,2,3,4,6,7,8-heptachlorodibenzodioxine | n.d. | 10 |
| octachlorodibenzodioxine ($Cl_8$-PCDD) | n.d. | 10 |

n.d. = not detectable
* = related to a single component of the homologous group

EXAMPLE 3

265 g of a solution of 15% n-butyllithium at 10° C. were charged into a reactor and 10.9 g Frigen 502 were isothermally added in a constant gas stream during 30 minutes. The afterreaction was performed for 100 minutes. Frigen 502 consists of 48.8% $CHClF_2$ and 51.2% $ClF_2CCF_3$. The complete decomposition of 10.9 g Frigen 502 resulted in a formation of 97.65 millimoles lithium chloride and 303.68 millimoles lithium fluoride, corresponding to an equivalent of 401.33 millimoles lithium. The consumption of butyllithium amounted to about 307.34 millimoles corresponding to 61.12 millimoles lithium chloride, resulting from the conversion of 62.6% of the chlorine, and 245.85 millimoles lithium fluoride, resulting from the conversion of 81.0% of the F.

EXAMPLE 4

294 g of a solution of 15% n-butyllithium at 0° C. were charged into a reactor and 10.8 g Frigen 502 were isothermally added in a constant gas stream during 30 minutes. The afterreaction was performed for 280 minutes. The complete decomposition of 10.8 g Frigen 502 resulted in the formation of 96.75 millimoles lithium chloride and 300.88 millimoles lithium fluoride corresponding to 397.63 millimoles lithium. The consumption of butyl lithium amounted to 340.74 millimoles corresponding to 72.8 millimoles lithium chloride, resulting from the conversion of 75.2% of the Cl, and 267.95 millimoles lithium fluoride, resulting from the conversion of 89.0% of the F.

From Examples 3 and 4 it is apparent that the halohydrocarbon compounds are substantially decomposed.

It will be appreciated that the instant specification and claims are set forth by way of illustration and not limitation, and that various modifications and changes may be made without departing from the spirit and scope of the present invention.

What is claimed is:

1. In the decomposition of a chlorofluorohydrocarbon by reacting it with a metal-containing material, the improvement which comprised decomposing said chlorofluorohydrocarbon dissolved or suspended in a hydrocarbon with a strongly basic hydrocarbon-soluble lithium compound.

2. The method according to claim 1, wherein the reaction with the lithium compound is effected in an inert solvent at a temperature from about 0° to 200° C.

3. The process according to claim 1, wherein the lithium compound is at least one lithiumorganyl or lithium amide.

4. The process according to claim 1, wherein the lithium compound is at least one lithiumalkyl, lithiumcycloalkyl or lithiumaryl having 1 to 20 carbon atoms.

5. The process according to claim 1, wherein the hydrocarbon-soluble, strongly basic lithium compound is added to the chlorofluorohydrocarbon in a solution in an inert solvent.

6. The process according to claim 1, wherein the lithium compound is at least one of n-butyllithium, tertiary butyllithium, secondary butyllithium or phenyllithium, used as a 5 to 95% solution in an inert solvent.

7. The process according to claim 6, wherein the inert solvent is at least one of toluene, xylene or hexane and the reaction is effected at a temperature from about 0° to 150° C.

8. The process according to claim 1, wherein the lithium compound is at least one of lithium diisopropylamide and lithium diethylamide.

9. The process according to claim 2, including the further steps of purifying the solvent by distillation and in reusing it, and separating the lithium halide which has formed.

* * * * *